United States Patent [19]

Fukuichi

[11] 4,152,887

[45] May 8, 1979

[54] DIGITAL ELECTRONIC ALARM TIMEPIECE

[75] Inventor: Takuro Fukuichi, Tokyo, Japan

[73] Assignee: Kabushiki Kaisha Daini Seikosha, Japan

[21] Appl. No.: 776,891

[22] Filed: Mar. 11, 1977

[30] Foreign Application Priority Data

Mar. 15, 1076 [JP] Japan ..... 51-27803

[51] Int. Cl.[2] ..... G04C 21/16

[52] U.S. Cl. ..... 58/19 R; 58/57.5; 58/16 D; 58/19 C

[58] Field of Search ..... 58/16 D, 16.5, 21.1, 58/57.5, 152 B, 38, 21.12, 19 R, 85.5, 126 C, 19 C

[56] References Cited

U.S. PATENT DOCUMENTS

| | | | |
|---|---|---|---|
| 3,938,317 | 2/1976 | Spano | 58/126 C |
| 3,946,549 | 3/1976 | Cake | 58/57.5 |
| 4,044,544 | 8/1977 | Yagi | 58/152 B |

*Primary Examiner*—Robert K. Schaefer

*Assistant Examiner*—Leonard W. Pojunas

*Attorney, Agent, or Firm*—Robert E. Burns; Emmanuel J. Lobato; Bruce L. Adams

[57] ABSTRACT

A digital alarm timepiece comprising an oscillator circuit for generating a standard time signal, a frequency dividing circuit, time counting circuits for counting output signals of the dividing circuit to provide a time signal, alarm time memory counting circuits for setting a selected alarm time, display means for selectively displaying the time signal and the set alarm time, alarm sound generating means and a coincidence circuit for activating the alarm sound generating means upon occurrence of coincidence between the set time of the alarm and the time signal has circuit means including manually operable switch means for amending the count of the time counting ciruits, to correct the time signal and for amending the count of the alarm time memory counting circuits to set a selected alarm time and means for activating the alarm sound generating means whenever the switch means is operated to amend the count of one or another of the counting means.

6 Claims, 2 Drawing Figures

DIGITAL ELECTRONIC ALARM TIMEPIECE

FIELD OF INVENTION

The present invention relates to a digital electronic alarm timepiece and in particular to means for activating alarm sound producing means whenever switching means is operated to correct the time or to set the alarm time.

BACKGROUND OF THE INVENTION

In the conventional type of digital electronic alarm timepieces the alarm sound generating means is activated only when the time signal output of the time counting circuits coincides with the set time of an alarm time memorizing counter. Hence an alarm sound can be obtained only by waiting for the time signal to coincide with the preset alarm time or by amending either the time counter or the alarm time memorizing counter so as to obtain coincidence.

SUMMARY OF THE INVENTION

It is an object of the present invention to overcome the limitations of conventional digital electronic alarm timepieces. In accordance with the invention the alarm sound generating means is activated not only by the coincidence means as in conventional electronic alarm timepieces but also by the operation of switching means for selectively amending the count of time counting circuit means for counting output signals of oscillator-dividing circuit means to provide a time signal and the count of alarm time memory counting circuit means for setting a selected alarm time. The sound generating means thus serves the dual function of providing the usual alarm time signal at the time for which the alarm timepiece has been set and also of providing an indication of operation of the switching means with which the timepiece is provided.

BRIEF DESCRIPTION OF THE DRAWINGS

The above mentioned and further object, features and advantages of the present invention will be more fully understood from the following description in conjunction with the accompanying drawings which show by way of example a preferred embodiment of the invention. In the drawings

DESCRIPTION OF PREFERRED EMBODIMENT

Figure 1:
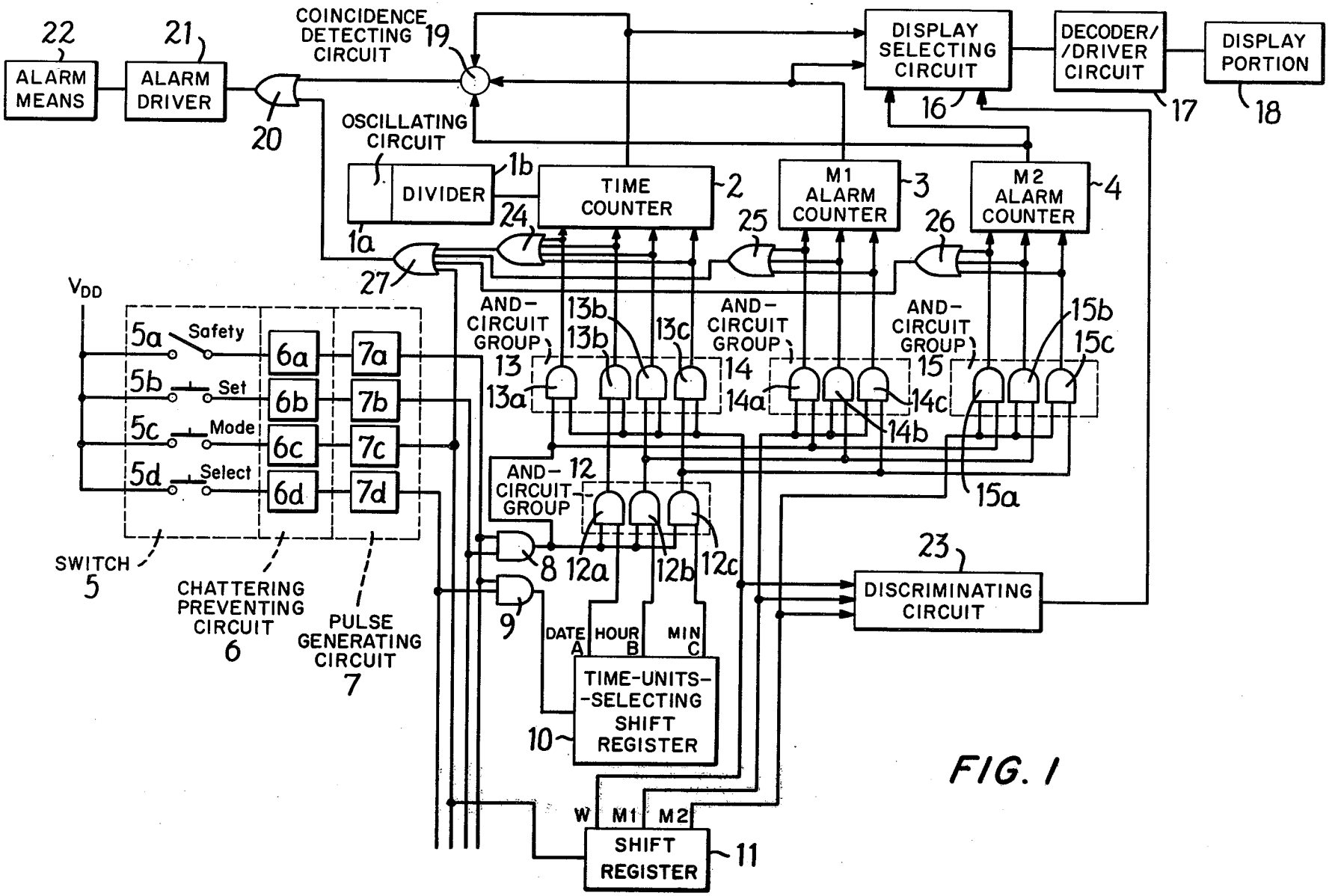
FIG. 1 is a circuit diagram showing the basic circuit construction of a digital electronic alarm timepiece in accordance with the invention and FIG. 2 is a time chart illustrating in part the operation of the timepiece circuitry shown in FIG. 1.

FIG. 1 shows a basic circuit construction of an electronic alarm timepiece in accordance with the present invention. A standard signal generated by an oscillator circuit 1*a* is divided by a dividing circuit 1*b* and the divided signal is applied to a time counter 2 comprising a second counter, minute counter, hour counter and date counter. The time counter 2 accordingly produces second, minute, hour and date signals which are selectively displayed through a display change-over circuit 16 and decoder driver 17 by digital display means 18. The circuit further includes a first alarm time memory counter 3 (hereinafter designated as M1 counter) and a second alarm time counter 4 (hereinafter designated as M2 counter). Thus two alarm times can be set by the two alarm time memory counters 3 and 4.

Means for amending the count of the time counter 2 to correct the time signal and for amending the count of alarm time memory counters 3 and 4 to set selected alarm times comprises a switch group 5 which is shown as comprising four individual switches 5*a*, 5*b*, 5*c* and 5*d*. One terminal of the switch group 5 is connected to a positive electrical potential (VDD) while the other terminal is connected through a chatter preventing circuit 6 to pulse generating circuitry 7. The circuitry 7 comprises four circuits 7*a*, 7*b*, 7*c* and 7*d* connected through the chatter preventing circuit 6 with the switches 5*a*, 5*b*, 5*c* and 5*d* respectively. Each of circuits 7*b*, 7*c* and 7*d* produces a pulse signal having a predetermined pulse width whenever the corresponding switch of switch group 5 is closed. However the output of circuit 7*a* is not changed to a pulse but is maintained as a positive electrical potential (VDD) during the time switch 5*a* is ON and is maintained at a negative electrical potential (VSS) when the switch 5*a* is OFF.

The outputs of circuits 7*a* and 7*b* are applied to the inputs of an AND circuit 8. The outputs the circuit 7*a* and 7*d* are applied to the inputs of an AND circuit 9. The output of the pulse generating circuit 7*c* is applied to the input of a channel selecting shift register 11 having three outputs W, M1 and M2. The output of the AND circuit 8 is connected to one input terminal of each of the three AND circuits of AND circuit group 12 and is also connected to one input terminal of AND circuit 13*a* in AND circuit group 14, one input terminal of AND circuit 14*a* of AND circuit group 14 and one input terminal of AND circuit 15*a* of AND circuit group 15.

The output of the AND circuit 9 is applied to the input of a time-units-selecting shift register 10 having three outputs A, B and C. A signal is generated at one of the three output terminals in response to the number of input pulses applied by the AND circuit 9.

The three output terminals of shift register 10 are respectively connected to the other input terminals of the AND circuits 12*a*, 12*b* and 12*c*. The output of AND circuit 12*a* of AND circuit group 12 is connected to one input terminal of AND circuit 13*b* of AND circuit group 13. The output of AND circuit 12*b* is connected to one input of AND circuit 13*c* and also to one input of AND circuit 14*b* of AND circuit group 14 and one input of AND circuit 15*b* of AND circuit group 15. The output of AND circuit 12*c* is connected to one input of AND circuit 13*d*, one input of AND circuit 14*c* and one input of AND circuit 15*c*.

The shift register 11 sequentially generates an output signal from the three output terminals in response to the number of input pulses received from the pulse generating circuit 7*c*. The output W of shift register 11 is connected to the other input terminals of each of the AND circuits of AND circuit group 13. The output M1 is connected to the other inputs of the AND circuits of AND circuit group 14 while the output M2 is connected to the other input terminals of the AND circuits of AND circuit group 15. Moreover the outputs W, M1 and M2 are applied to a discriminating circuit 23 for discriminating a signal generated by an output terminal of shift register 11. The output of the discriminating circuit 23 is applied to the display selecting circuit 16 which selects and displays a certain channel (namely a time display W, a first alarm time display M1 and a second alarm time display M2) by the output signal of the discriminating circuit 23.

The outputs of AND circuit groups 13, 14 and 15 are respectively applied to the time counter 2, the first alarm time counter 3 and the second alarm time counter 4. The contents of the time counter 2, the first alarm time counter 3 and the second alarm time counter 4 are respectively applied to inputs of the display selecting circuit 16, the output of which is connected through the decoder driver 17 to the display device 18. The contents of only one of the counters 2, 3 and 4 applied to the display selecting circuit 16 is selected and generated by a signal of the discriminating circuit 23 and is displayed by the display device 18 through the decoder driver circuit 17. Selection of the channel (time display W, first alarm time display M1 and second alarm time display M2) is controlled by the shift register 11 under control of the switch group 5. Selection of a particular counter (date, hour or minute) of the selected channel is controlled by the shift register 10 under control of the switch group 5.

The contents of the time counter 2, the first alarm time counter 3 and the second alarm counter 4 are also respectively applied to a coincidence detecting circuit 19 for generating a coincidence signal when the contents of the time counter 2 coincides with the contents of the alarm time counter 3 or the contents of the alarm time counter 4. The output of the coincidence detecting circuit 19 is connected through an OR circuit 20 and driver 21 to an alarm sound generating device 22. When a coincidence signal is generated by the coincidence detecting circuit 19 the alarm sound generating means 22 is driven by the ON state of the alarm driver 21 through the OR circuit 20.

The outputs of AND circuit groups 13, 14 and 15 are applied respectively to inputs of OR circuits 24, 25 and 26. The outputs of OR circuits 24, 25 and 26 are applied to OR circuit 27 together with the output of the pulse generating circuit 7*c*. The output of the OR circuit 27 is applied to the other input terminal of OR circuit 20. Hence the alarm sound generating means 22 is activated by output signals of AND circuit groups 13, 14 and 15 and also by an output signal from the pulse generating circuit 7*c*.

The operation of the digital alarm timepiece of which the circuitry is shown by way of example in FIG. 1 will now be described with reference to the time chart shown in FIG. 2.

The switches of switch group 5 are normally in OFF condition. When only the switch 5*c* is pushed to change it to ON state a pulse signal having a certain period is generated at the output terminal of the pulse generating circuit 7*c*. This pulse signal is applied to the input of the channel selecting shift register 11 so as sequentially to generate outputs signals W, M1 and M2 according to the number of pulses generated at the output of the pulse generating circuit 7. The contents of the counters 2, 3 and 4 are accordingly selected by the display selecting circuit 16 under control of the output signal of the discriminating circuit 23 for display by the display mens 18. Moreover a pulse signal generated by the pulse generating circuit 7 is transmitted to the driver 21 of the alarm sound generating means 22 through OR circuits 27 and 20 so as to activate the alarm means 22 to produce an alarm sound only during the time of the pulse width of the pulse generated by the pulse generating circuit 7*c*.

To reset the second counter of the time counter 2 the switch 5*a* is operated so that the switch is in the ON state. The output of the pulse generating circuit 7*a* whereupon becomes and remains at level "1". If the shift register 11 is not already in condition to provide a time display the switch 5*c* is pushed the required number of times to activate the time display channel. In this condition only the output W of the shift register 11 is as level "1" the remaining two outputs M1 and M2 being at the level "O". Hence AND circuit groups 14 and 15 are in the OFF state. Moreover the three outputs of the shift register 10 are at level "0" since AND circuit 9 is in the OFF state. The output of AND circuit group 12 is hence maintained at level "O" whereby AND circuits 13*b*, 13*c* and 13*d* are in the OFF state. Hence only AND circuit 13*a* in AND circuit group 13 is able to pass a pulse signal. When the switch 5*b* is pushed one pulse is produced by the pulse generating circuit 7*b*. This pulse is transmitted through the AND circuit 13*a* to the second counter of the time counter 2 whereby the second counter is reset by the pulse signal. Moreover the pulse signal passes sequentially through OR circuits 24, 27 and 20 and actuates the alarm driver 21 so as to be in the ON state whereby the alarm sound generating means 22 produces an alarm sound during the duration of the pulse signal.

The alarm time memory counters 3 and 4 are reset in similar manner. When the switch 5*b* is pushed after selection of the desired channel a pulse signal is applied to AND circuit 15*a* in the case of resetting M2 counter 4 and is applied to AND circuit 14*a* in the case of resetting M1 counter 3. It is thus possible to reset each alarm time memory counter. Simultaneously a pulse is transmitted through OR circuits 25 or 26, 27 and 20 to actuate the alarm driver 21 and thereby produce an alarm sound for the duration of the pulse.

Referring now to a time correcting operation the switch 5*a* is positioned in the ON state so that the pulse generating circuit 7*a* maintains a level "1". The switch 5*c* is pushed the required number of times to shift the shift register 11 to the time counter channel whereby only output W is at level "1". In case of correcting the date counter of the time counter 2 it is necessary to push the switch 5*d* once whereby one pulse signal is produced at the output of the pulse generating circuit 7*d*. The pulse is transmitted through the AND circuit 9 to shift the shift register 10 to the state in which the "date" output A becomes level "1" while outputs B and C remain at level "O". AND circuits 12*a* and 13*b* are thereby able to pass a pulse signal. When the switch 5*b* is then pushed a pulse produced by the corresponding pulse generating circuit 7*b*, is transmitted through AND circuit 8, AND circuit 12*a* and AND circuit 15*b* to the date counter of time counter 2. By operation of the switch 5*d* the required number of pulses are transmitted to the date counter to set the date counter as desired. If the second reset signal is set to be ineffective in spite of an application of a second reset signal only the "date" figure is corrected.

Each time a pulse signal is produced by the pulse generating circuit 7*b*, upon operation of the switch 5*b* the pulse signal is transmitted through OR circuits 24, 27 and 20 to the alarm driver 21 so as to produce an alarm sound. Hence the number of pulses can be counted by listening to the alarm sound generating means.

Similarly correction of the hour and minute counters of the time counter 2 is effected by operation of the switch 5*b* after selection of the desired channel and counter. As in the case of "date" correction the shift register 11 is in the state that only output W is at level "1". The shift register 10 is shifted by operation as switch 5d with switch 5a in the ON state to activate output B in the case of hour correction and the output C in the case of minute correction. Therefore a pulse signal produced by pulse generating circuit 7b upon operation of the switch 5b is transmitted to the time counter 2 through AND circuits 8, 12a and 12b in the case of hour correction and through AND circuits 8, 12c and 13d in the case of minute correction. Similarly only hour or minute correcting signals are able to be effective if the second reset signal is set to be ineffective. Moreover in like manner these correcting pulse signals are transmitted through OR circuits 24, 27 and 20 to the alarm driver 21 whereby an alarm sound is produced by each pulse.

It is possible in like manner to set an alarm time in each of the alarm time memory counters 3 and 4. The desired alarm memory counter is selected by the shift register 11 under control of the switch 5c. For setting an alarm time in M1 counter 3 the M1 output of shift register 11 is at level "1" while the other outputs are at level "0". For setting an alarm time in M2 counter 4 the M2 output of shift register 11 is at level "1" while the other outputs are at level "0". In each case the date, hour and minute counters of the alarm time memory counters are selected by operation of the shift register 10 under control of the switch 5d as in the case of time correction. Pulses are thereupon applied to the selected counter by operation of the switch 5b to set the alarm time as desired. In each case a pulse signal is transmitted through OR circuits 25 or 26, 27 and 20 to activate the alarm driver 21 whereby an alarm sound is produced by each pulse signal.

When the current time as counted by the time counter 2 coincides to a set alarm time the output of the coincidence circuit 19 becomes level "1" and actuates the alarm driver 21 through OR circuit 20. The alarm sound generating means 22 is thereby energized to produce an alarm sound.

Figure 2:
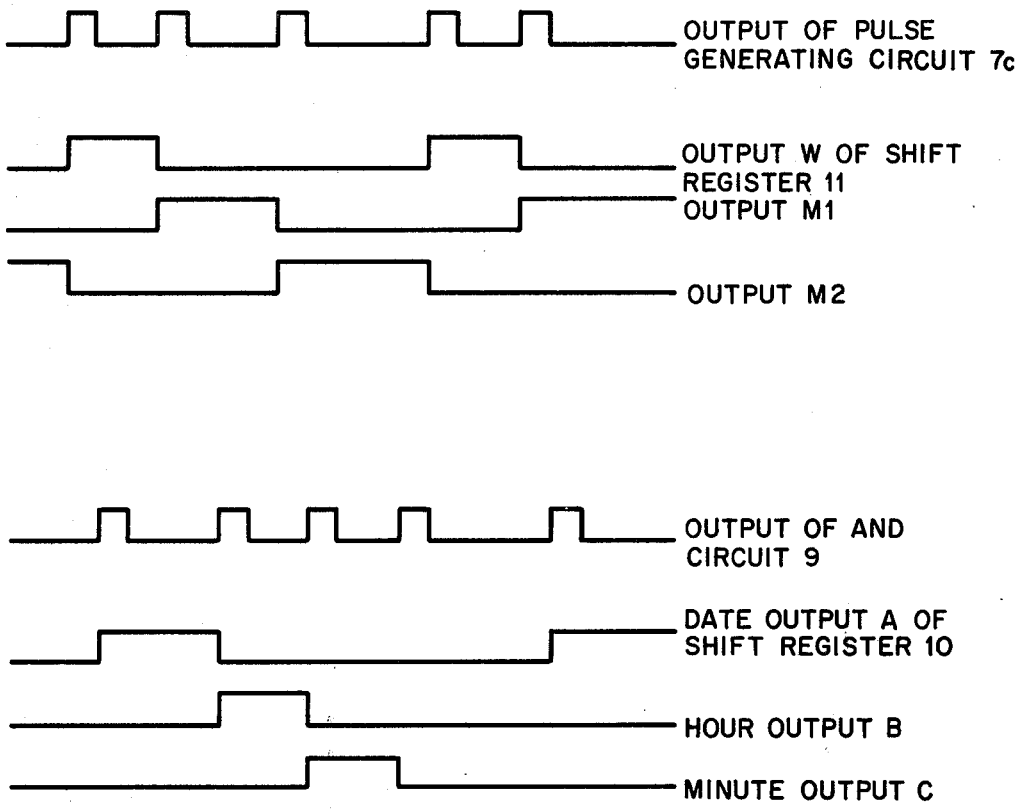

FIG. 2 is a wave form time chart illustrating control of the shift registers 10 and 11 by operation of switches 5d and 5c respectively. Thus it will be seen that successive pulses produced by pulse generating circuit 7c upon operation of the switch 5c are applied to the shift register 11 so as to activate the desired output. In like manner pulses generated by pulse generating circuit 7d upon operation of the switch 5d are passed through AND circuit 9 to shift the shift register 10 to activate the desired output terminal.

It will thus be seen that in accordance with the present invention an electronic alarm timepiece is able to produce a sound according to a switching operation whereby a wearer of the timepiece is able directly and exactly to acknowledge actuation of the switch.

While a preferred embodiment of the invention has been illustrated in the drawings and is herein particularly described it will be understood that modifications and variations may be made and that the invention is hence not limited to this embodiment.

What is claimed is:

1. A digital electronic alarm timepiece comprising standard signal generating means, circuit means for frequency-dividing the signal generated by said standard signal generating means, time counting circuit means for counting output signals of said dividing circuit means to provide a time signal, alarm time memory counting circuit means, setting means including manually operable switching means for selectively amending the count of said time counting circuit means to correct the time signal and for amending the count of said alarm time memory counting circuit to set a selected alarm time, visual display means controlled by said setting means for selectively displaying the time signal of said time counting circuit means and the set time of said alarm time memory counting circuit means, coincidence circuit means having inputs connected respectively with said time counting circuit means and said alarm time memory counting circuit means to detect coincidence between said time signal and said set alarm time, an OR circuit having a first input connected with an output of said coincidence circuit means and a second output connected with said setting means, alarm driver means connected to the output of said OR circuit and alarm sound generating means connected to and driven by said alarm driver means, hereby said alarm sound generating means is activated to produce an alarm sound upon coincidence of said time signal and set alarm time and upon operation of said setting means to set an alarm time.

2. A digital alarm timepiece according to claim 1, in which said switching means comprises a plurality of switches operable in selected different combinations to amend the count of said time counting circuit means to correct the time signal and to amend the count of said alarm time memory counting circuit means to set a selected alarm time.

3. A digital alarm timepiece according to claim 2, in which each of said counting circuit means comprises a plurality of counters and in which a first shaft register is controlled by said switching means to select the counting circuit means to be amended and a second shift register is controlled by said switching means to select the counter of the selected counting circuit means to be amended.

4. A digital electronic alarm timepice comprising a standard signal generating means, circuit means for frequency-dividing the signal generated by said standard signal generating means, time counting circuit means for counting output signals of said dividing circuit means to provide a time signal, alarm time memory counting circuit means for setting a selected alarm time, setting means for selectively amending the count of said time counting circuit means and said alarm time memory counting circuit means comprising a manually operable switch group comprising a safety switch, a set switch, a mode switch and a select switch, a first AND circuit having inputs connected with said safety switch and said set switch, a second AND circuit having inputs connected with said safety switch and said select switch, a first shift register having a plurality of outputs and having an input connected with the output of said second AND circuit, a second shift register having a plurality of outputs and having an input connected with said mode switch, a first AND switch group comprising AND circuits having inputs connected with the output of said first AND circuit and with outputs of said first shift register respectively, a second AND circuit group comprising an AND circuit having a first input connected with the output of said first AND circuit and a plurality of AND circuits each having an input connected respectively with outputs of AND circuits of said first AND circuit group, said AND circuits of said second AND circuit group having second inputs connected respectively with outputs of said second shift register, a third AND circuit group comprising an AND circuit having a first input connected with the output of said first AND circuit and a plurality of AND circuits each having an input connected respectively with outputs of AND circuits of said first AND circuit group, said AND circuits of said third AND circuit group having second inputs connected respectively with outputs of said second shift register, means connecting outputs of said AND circuits of said second AND circuit group with said time counting circuit means to set the time, means connecting outputs of said AND circuits of said third AND circuit group to said alarm memory counting circuit means to set an alarm time, a discriminating circuit having inputs connected respectively with outputs of said second shift register, a display selecting circuit having inputs connected respectively with said time counting circuit means and with said alarm time memory counting circuit means and a control input connected with an output of said discriminating circuit, visual display means connected with said display selecting circuit to display the time count selected by said display selecting circuit, coincidence detecting circuit means having inputs connected respectively with said time counting circuit means and with said alarm time memory counting circuit means to detect coincidence between the time signal of said time counting circuit means and a set alarm time of said alarm time memory counting circuit means, an OR circuit having a first input connected to an output of said coincidence detecting circuit means and means connecting a second input of said OR circuit with said mode switch, an alarm driver connected with the output of said OR circuit and alarm sound generating means connected to and driven by said alarm driver, whereby said alarm sound generating means is activated to produce an alarm sound upon coincidence of said time signal with said set alarm time and upon activation of said mode switch to set an alarm time.

5. A digital electronic alarm timepiece according to claim 4, further comprising a second OR circuit having inputs connected respectively with outputs of AND circuits of said second AND circuit group, a third OR circuit having inputs connected respectively with outputs of AND circuits of said third AND circuit group and a fourth OR circit having inputs connected respectively with said mode switch and outputs of said second and third OR circuits and an output connected with an input of said first mentioned OR circuit, said fourth OR circit constituting said means connecting an input of said first mentioned OR circuit with said mode switch.

6. A digital electronic alarm timepiece according to claim 5, further comprising a fourth AND circuit group comprising an AND circuit having a first input connected with the output of said first AND circuit and a plurality of AND circuits each having an input connected respectively with outputs of said first AND circuit group, said AND circuits of said fourth AND circuit group having second inputs connected respectively with outputs of said second shift register, second alarm time memory counting means having inputs connected respectively with outputs of AND circuits of said fourth AND circuit group and an output connected with said display selecting circuit and a fifth OR circuit having inputs connected respectively with outputs of AND circuits of said fourth AND circuit group and an output connected with an input of said fourth OR circuit.

* * * * *